US011367963B2

(12) United States Patent
Tanbo et al.

(10) Patent No.: US 11,367,963 B2
(45) Date of Patent: Jun. 21, 2022

(54) ANTENNA DEVICE

(71) Applicant: Murata Manufacturing Co., Ltd., Kyoto (JP)

(72) Inventors: Yasuo Tanbo, Kyoto (JP); Masahiro Izawa, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 17/000,730

(22) Filed: Aug. 24, 2020

(65) Prior Publication Data

US 2020/0388925 A1 Dec. 10, 2020

Related U.S. Application Data

(63) Continuation of application No. PCT/JP2019/013263, filed on Mar. 27, 2019.

(30) Foreign Application Priority Data

Apr. 13, 2018 (JP) ..... JP2018-078023

(51) Int. Cl.
*H01Q 11/14* (2006.01)
*H01Q 5/335* (2015.01)
(Continued)

(52) U.S. Cl.
CPC ..... *H01Q 11/14* (2013.01); *H01Q 1/38* (2013.01); *H01Q 5/314* (2015.01); *H01Q 5/335* (2015.01); *H01Q 5/371* (2015.01); *H01Q 5/45* (2015.01)

(58) Field of Classification Search
CPC ..... H01Q 11/14; H01Q 5/335; H01Q 5/45; H01Q 5/314; H01Q 1/38; H01Q 5/371; H01Q 13/08; H01Q 13/18; H01Q 9/42
See application file for complete search history.

(56) References Cited

U.S. PATENT DOCUMENTS

2008/0007461 A1* 1/2008 Su ..... H01Q 5/40 343/700 MS
2011/0012794 A1 1/2011 Schlub et al.
(Continued)

FOREIGN PATENT DOCUMENTS

JP 2006-140735 A 6/2006
JP 2006140735 A * 6/2006
(Continued)

OTHER PUBLICATIONS

International Search Report issued in Application No. PCT/JP2019/013263, dated Jun. 4, 2019.
(Continued)

*Primary Examiner* — Andrea Lindgren Baltzell
*Assistant Examiner* — Yonchan J Kim
(74) *Attorney, Agent, or Firm* — Pearne & Gordon LLP

(57) ABSTRACT

A conductor pattern of an antenna device is provided in a notch and includes a common conductor, a first conductor, and a second conductor. A power supply unit is disposed at a connection portion between a conductor plate and the conductor pattern. Each of the first conductor and the second conductor is connected to the power supply unit with the common conductor interposed therebetween. The power supply unit is positioned at a position at which a distance to an opening end is shorter than a distance to a closed end at a side end. A first partial conductor of the first conductor is positioned between the second conductor and a side end. A length of the first conductor in a direction along the side end is longer than a length of the second conductor in the direction along the side end.

15 Claims, 12 Drawing Sheets

(51) Int. Cl.

| | |
|---|---|
| ***H01Q 5/45*** | (2015.01) |
| ***H01Q 1/38*** | (2006.01) |
| ***H01Q 5/371*** | (2015.01) |
| ***H01Q 5/314*** | (2015.01) |

(56) References Cited

U.S. PATENT DOCUMENTS

| | | | | |
|---|---|---|---|---|
| 2011/0187615 | A1* | 8/2011 | Sakata | H01Q 9/40 343/722 |
| 2015/0102974 | A1* | 4/2015 | Stoytchev | H01Q 9/285 343/843 |
| 2018/0123244 | A1* | 5/2018 | An | H01Q 9/285 |

FOREIGN PATENT DOCUMENTS

| | | | | |
|---|---|---|---|---|
| JP | 2007-311944 | A | | 11/2007 |
| JP | 2007311944 | A | * | 11/2007 |
| JP | 2016-134772 | A | | 7/2016 |
| JP | 2016-134773 | A | | 7/2016 |
| JP | 2017-038153 | A | | 2/2017 |
| JP | 2017038153 | A | * | 2/2017 |
| WO | 2012/160947 | A1 | | 11/2012 |

OTHER PUBLICATIONS

Written Opinion issued in Application No. PCT/JP2019/013263, dated Jun. 4, 2019.

* cited by examiner

ANTENNA DEVICE

This is a continuation of International Application No. PCT/JP2019/013263 filed on Mar. 27, 2019 which claims priority from Japanese Patent Application No. 2018-078023 filed on Apr. 13, 2018. The contents of these applications are incorporated herein by reference in their entireties.

BACKGROUND

Technical Field

The present disclosure relates to an antenna device configured to transmit and receive a plurality of signals having different frequencies from each other.

In related art, a so-called notch antenna in which a notch is provided in a ground plate (conductor plate) has been proposed (see Patent Document 1).

A planar antenna (antenna device) of Patent Document 1 includes a ground plate (conductor plate) in which a notch having a predetermined shape is formed, a conductor portion (conductor pattern) disposed inside the notch and separated from the ground plate, a power supply point disposed on an end side of the ground plate and configured to supply power to the conductor portion, and an open end configured to electrically isolate the ground plate and the conductor portion from each other.

With this configuration, the planar antenna of Patent Document 1 resonates at a desired operating frequency, and can operate as an antenna.

Patent Document 1: Japanese Unexamined Patent Application Publication No. 2006-140735

BRIEF SUMMARY

In recent years, it has been desired to transmit and receive a plurality of signals having different frequencies from each other by using one planar antenna. However, since the planar antenna (antenna device) of Patent Document 1 resonates at one frequency, resonance corresponding to each of a plurality of frequencies cannot be performed. Therefore, the planar antenna (antenna device) of Patent Document 1 cannot be used as an antenna for transmitting and receiving signals at a plurality of frequencies.

The present disclosure provides an antenna device configured to perform resonance corresponding to each of a plurality of frequencies and configured to transmit and receive a plurality of signals having different frequencies from each other.

An antenna device according to an aspect of the present disclosure is configured to transmit a signal having a first frequency and a signal having a second frequency higher than the first frequency. The antenna device includes a conductor plate provided with a notch having an opening end at one end, a closed end at the other end, and a pair of side ends between the opening end and the closed end, a conductor pattern, and a power supply unit. The conductor pattern is provided in the notch, and includes a common conductor, a first conductor, and a second conductor. The power supply unit is disposed at a connection portion between the conductor plate and the conductor pattern, and is configured to supply power to the conductor pattern. Each of the first conductor and the second conductor is connected to the power supply unit with the common conductor interposed therebetween. The power supply unit is disposed at a position at which a distance to the opening end is shorter than a distance to the closed end at one side end of the pair of side ends. A part of the first conductor is positioned between the second conductor and the other side end of the pair of side ends. A length of the first conductor in a direction along the other side end is longer than a length of the second conductor in the direction along the other side end.

According to the antenna device of the above aspect of the present disclosure, resonance corresponding to each of a plurality of frequencies can be performed, and a plurality of signals having different frequencies from each other can be transmitted and received.

DETAILED DESCRIPTION

Figure 1A:
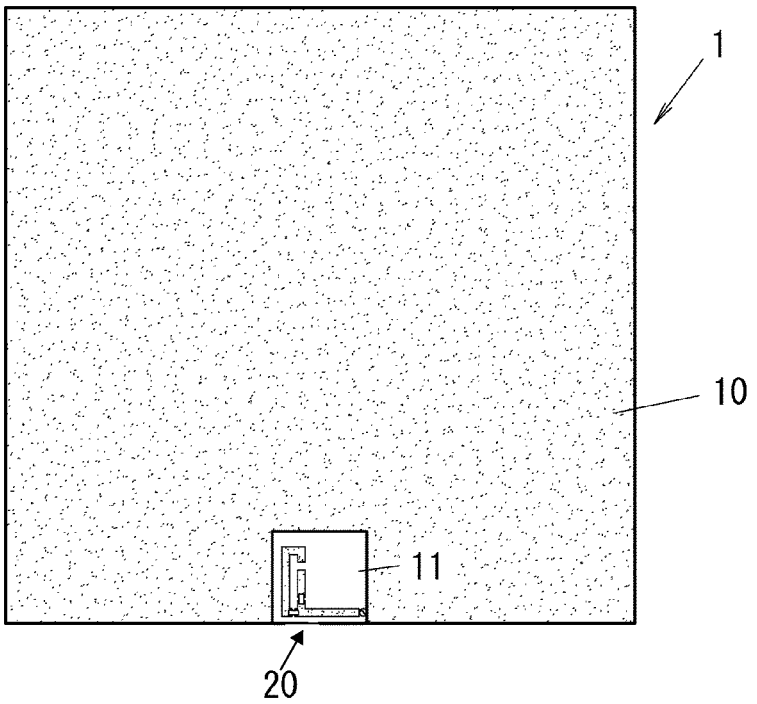
FIG. 1A is a diagram schematically illustrating an antenna device according to Embodiment 1.

The embodiments and modifications to be described below are merely examples of the present disclosure, and the present disclosure is not limited to the respective embodiments and modifications. Other than these embodiments and modifications, various changes can be made according to design and the like within a range that does not depart from the technical idea of the present disclosure. In addition, in the following embodiments and modifications, each drawing is a schematic diagram, and each ratio of the sizes and the thicknesses of the respective constituent elements in the drawings does not necessarily reflect the actual dimension ratio.

Embodiment 1

Hereinafter, an antenna device according to the present embodiment will be described with reference to FIG. 1A to FIG. 4.

(1) Outline

An antenna device 1 according to the present embodiment is used as an antenna device for transmitting and receiving signals in respective frequency bands for a mobile phone, a smartphone, or the like. For example, the antenna device 1 according to the present embodiment is a notch antenna.

The antenna device 1 is configured to transmit and receive signals at a plurality of frequencies. The antenna device 1 is configured to transmit and receive signals at respective frequencies of 2.4 GHz as a first frequency and 5.5 GHz as a second frequency. That is, the antenna device 1 is configured to be able to resonate at the plurality of frequencies.

(2) Configuration

As illustrated in FIG. 1A, the antenna device 1 according to the present embodiment includes a conductor plate 10 having a rectangular shape (here, a square shape) and having a notch 11 at one end portion thereof (see FIG. 1A). The conductor plate 10 is formed of a conductive material (for example, copper), and is provided in, for example, a resin substrate (printed board). An electric potential of the conductor plate 10 is a ground potential. That is, the conductor plate 10 is grounded. Note that the conductor plate 10 may have a single layer or multi-layers. When the conductor plate 10 is provided in multi-layers, for example, when the conductor plate 10 is provided on each surface of the printed board, the conductor plate 10 on one surface has the same shape as that of the conductor plate 10 on the other surface.

The notch 11 has an opening end 111 on a side of one end portion of the conductor plate 10. The notch 11 has a closed end 112 facing the opening end 111 and positioned on an inner side than the opening end 111. Further, the notch 11 has side ends 113 and 114 between the opening end 111 and the closed end 112, and the side ends 113 and 114 are provided so as to face each other (see FIG. 1B). Here, the notch 11 is configured such that a total length of a length of the closed end 112 and lengths of the side ends 113 and 114 is half of a wave length of the first frequency.

Figure 1B:
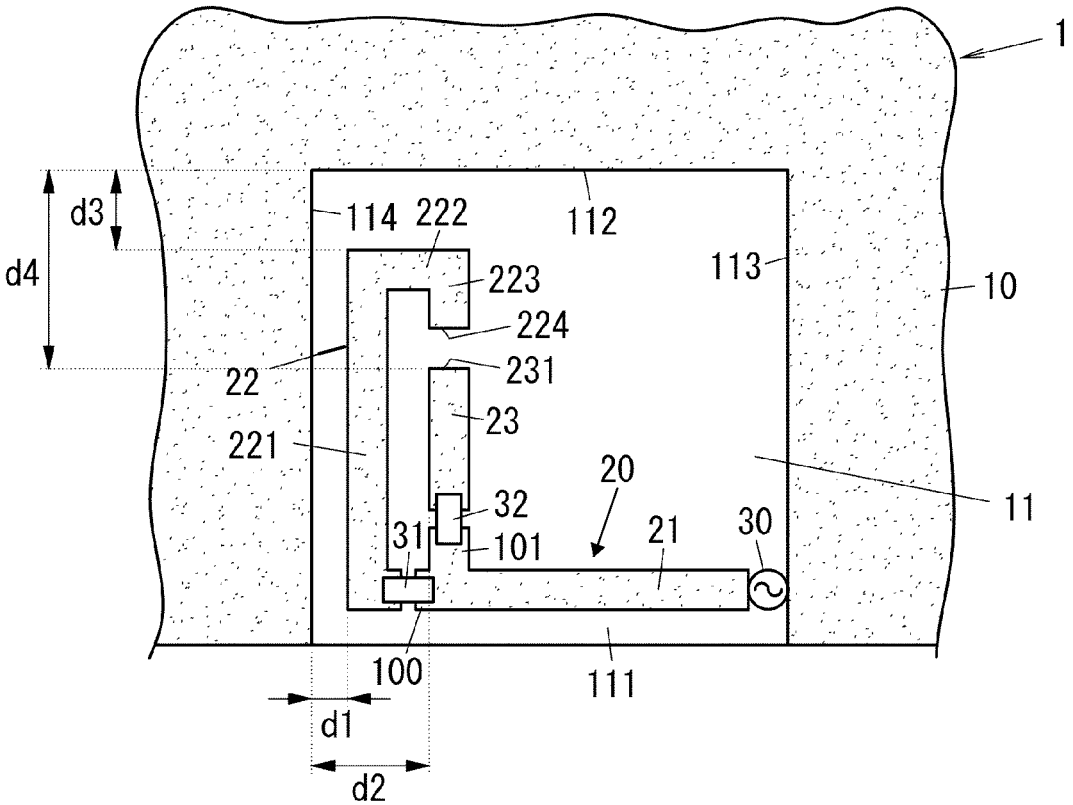
FIG. 1B is a diagram schematically illustrating a main part of the antenna device described above.

As illustrated in FIG. 1B, the antenna device 1 includes a conductor pattern 20, a power supply unit 30, a first frequency adjustment element 31, and a second frequency adjustment element 32 in the notch 11.

The conductor pattern 20 is patterned with a conductive material (for example, copper) on a printed board on which the conductor plate 10 is formed. The conductor pattern 20 may be formed by using a part of the conductor plate 10. The conductor pattern 20 is electrically insulated from the conductor plate 10.

The conductor pattern 20 has a common conductor 21, a first conductor 22, and a second conductor 23. Each of the first conductor 22 and the second conductor 23 is connected to the power supply unit 30 with the common conductor 21 interposed therebetween.

The common conductor 21 is provided so as to exist and extend in a direction from the side end 113 toward the side end 114 on the opening end 111 side. The power supply unit 30 is provided between one end of both ends of the common conductor 21 and the side end 113. The other end of both ends of the common conductor 21 has a first portion 100 existing and extending in a direction toward the side end 114 and a second portion 101 existing and extending in a direction toward the closed end 112.

As illustrated in FIG. 1B, the first conductor 22 has a first partial conductor 221, a second partial conductor 222, and a third partial conductor 223.

The first partial conductor 221 is provided so as to exist and extend along a direction from the opening end 111 toward the closed end 112, that is, along the side ends 113 and 114. One end of the first partial conductor 221 is connected to the first portion 100 of the common conductor 21 with the first frequency adjustment element 31 interposed therebetween. The second partial conductor 222 is provided so as to exist and extend along a direction from the side end 114 toward the side end 113, that is, along the closed end 112. One end of the second partial conductor 222 is coupled to the other end of the first partial conductor 221. The third partial conductor 223 is provided so as to exist and extend along a direction from the closed end 112 toward the opening end 111, that is, along the side ends 113 and 114. One end of the third partial conductor 223 is coupled to the other end of the second partial conductor 222. That is, the first conductor 22 has an angular J-shape.

The second conductor 23 is provided so as to exist and extend along the direction from the opening end 111 toward the closed end 112. One end of the second conductor 23 is connected to the second portion 101 of the common conductor 21 with the second frequency adjustment element 32 interposed therebetween. An open end 231 which is the other end of the second conductor 23 is provided so as to face an open end 224 which is the other end of the third partial conductor 223. That is, the open end 224 of the first conductor 22 and the open end 231 of the second conductor 23 face each other to form a capacitor. In other words, the open end 224 of the first conductor 22 and the open end 231 of the second conductor 23 face each other so as to form a capacitor. A gap between the open end 224 of the first conductor 22 and the open end 231 of the second conductor 23 is formed as an air gap. It should be noted that resin may be provided between the open end 224 of the first conductor 22 and the open end 231 of the second conductor 23.

A part of the first conductor 22 (the first partial conductor 221) is disposed between the second conductor 23 and the side end 114. That is, a distance d1 between the first partial conductor 221 and the side end 114 is shorter than a distance d2 between the second conductor 23 and the side end 114. Here, the distance d1 between the first partial conductor 221 and the side end 114 is the shortest length between the first partial conductor 221 and the side end 114 in a direction in which the side end 113 and the side end 114 face each other. Note that the distance d1 between the first partial conductor 221 and the side end 114 may be the longest length between the first partial conductor 221 and the side end 114 in the above-described direction, or may be an average length thereof. Similarly, the distance d2 between the second conductor 23 and the side end 114 is the shortest length between the second conductor 23 and the side end 114 in the above-described direction. Note that the distance d2 between the second conductor 23 and the side end 114 may be the longest length between the second conductor 23 and the side end 114 in the above-described direction, or may be an average length thereof.

The first conductor 22 is configured such that a distance d3 between the second partial conductor 222 and the closed end 112 is longer than the distance d1 between the first partial conductor 221 and the side end 114.

The second conductor 23 is configured such that a distance d4 between a tip end portion of the second conductor 23 (the other end of the second conductor 23 described above) and the closed end 112 is longer than the distance d2 between the second conductor 23 and the side end 114.

A length of the first conductor 22 (a total value of a length in a longitudinal direction of the first partial conductor 221, a length in a longitudinal direction of the second partial conductor 222, and a length in a longitudinal direction of the third partial conductor 223) is longer than a length of the second conductor 23 (a length in a longitudinal direction of the second conductor 23).

The power supply unit 30 is disposed in a connection portion (at a connection position) where the conductor plate 10 and the conductor pattern 20 are connected to each other, and supplies power to the conductor pattern 20. Specifically, the power supply unit 30 is provided on the opening end 111 side between the common conductor 21 and the side end 113, and supplies power to the conductor pattern 20 (common conductor 21). Note that the power supply unit 30 may be provided on the opening end 111 side with respect to a middle point of the side end 113. In other words, the power supply unit 30 is provided on the side end 113 side such that a distance from the power supply unit 30 to the opening end 111 is shorter than a distance from the power supply unit 30 to the closed end 112.

The first frequency adjustment element 31 and the second frequency adjustment element 32 are chip elements, specifically ceramic chip inductors. Inductance of the first frequency adjustment element 31 is set within a range of 1 nH to 3 nH. Inductance of the second frequency adjustment element 32 is smaller than the inductance of the first frequency adjustment element.

The first frequency adjustment element 31 is configured such that, at the first frequency (2.4 GHz), impedance when the first conductor 22 is seen from the power supply unit 30 is lower than impedance when the second conductor 23 is seen from the power supply unit 30.

The second frequency adjustment element 32 is configured such that, at the second frequency (5.5 GHz), impedance when the second conductor 23 is seen from the power supply unit 30 is lower than impedance when the first conductor 22 is seen from the power supply unit 30.

In other words, at the first frequency, the respective first frequency adjustment element 31 and second frequency adjustment element 32 are configured such that reactance of the first frequency adjustment element 31 is smaller than reactance of the second frequency adjustment element 32. Further, at the second frequency, the respective first frequency adjustment element 31 and second frequency adjustment element 32 are configured such that reactance of the second frequency adjustment element 32 is smaller than reactance of the first frequency adjustment element 31.

That is, when a signal having the first frequency is input from the power supply unit 30 to the common conductor 21, the signal having the first frequency passes through the first frequency adjustment element 31, but it is difficult for the signal to pass through the second frequency adjustment element 32. When a signal having the second frequency is input from the power supply unit 30 to the common conductor 21, the signal having the second frequency passes through the second frequency adjustment element 32, but it is difficult for the signal to pass through the first frequency adjustment element 31. The first frequency adjustment element 31 and the second frequency adjustment element 32 function as filters for allowing a signal having a predetermined frequency to pass therethrough.

(3) Operation

Next, as an operation of the antenna device 1, a resonance operation when a signal having the first frequency is input to the conductor pattern 20 and a resonance operation when a signal having the second frequency is input to the conductor pattern 20 will be described.

(3-1) A Case where Signal Having First Frequency is Input

When a signal (current) having the first frequency is input to the common conductor 21 of the conductor pattern 20, the current having the first frequency passes through the first frequency adjustment element 31, but it is difficult for the current to pass through the second frequency adjustment element 32, so that the current having the first frequency flows through the first conductor 22.

Figure 2A:
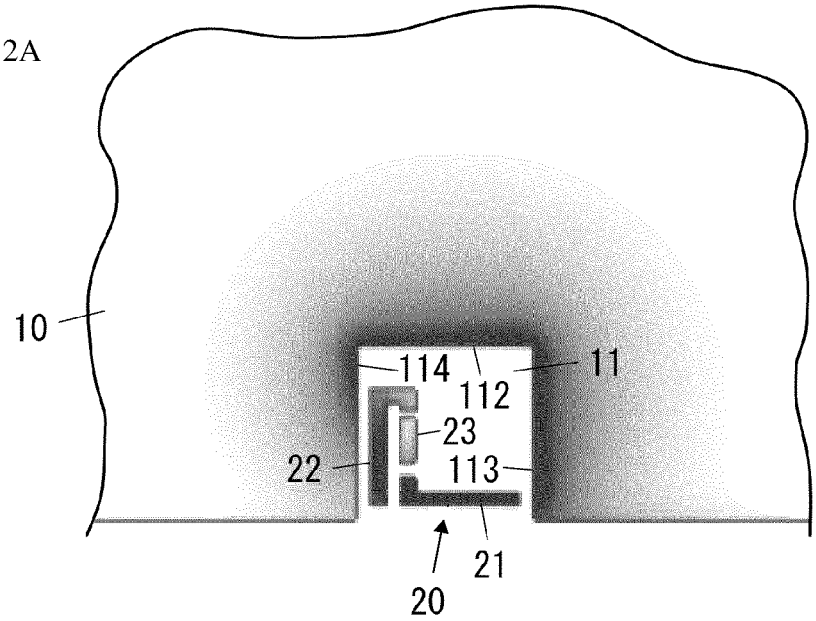
FIG. 2A is a diagram illustrating a current distribution when a current having a first frequency flows through the antenna device described above.

Since a capacitor is formed of the first partial conductor 221 of the first conductor 22 and the side end 114, the current having the first frequency flows through the capacitor formed of the first partial conductor 221 and the side end 114 to the side end 114. The current having the first frequency further flows in the order of the closed end 112 and the side end 113. FIG. 2A illustrates a current distribution when a current having the first frequency (2.4 GHz) is input to the common conductor 21. Regions illustrated in black in FIG. 2A represent parts through which the more current flows. With reference to FIG. 2A, as described above, it can be seen that the more current having the first frequency flows through the common conductor 21, the first conductor 22, the side end 114, the closed end 112, and the side end 113.

When the current at the first frequency flows, the common conductor 21 and the first conductor 22, and the first frequency adjustment element 31 form an inductor. Further, as described above, the first partial conductor 221 and the side end 114 form the capacitor. Accordingly, LC resonance occurs, and the conductor pattern 20 inside the conductor plate 10 and the notch 11 serves as an antenna region based on this resonance, so that the antenna device 1 operates as an antenna.

In this case, a resonant frequency is calculated as a reciprocal of a value obtained by multiplying a square root of a product of inductance of the inductor described above and capacitance of the capacitor described above by "2π". The length of the first conductor 22 is longer than the length of the second conductor 23. Therefore, in a case where a current having the first frequency flows through the common conductor 21, the inductance of the inductor formed of the common conductor 21, the first conductor 22, and the first frequency adjustment element 31 is larger than inductance of an inductor formed of the common conductor 21, the second conductor 23, and the second frequency adjustment element 32. Further, since the distance d1 between the first conductor 22 (in particular, the first partial conductor 221) and the side end 114 is shorter than the distance d2 between the second conductor 23 and the side end 114, the capacitance of the capacitor formed of the first conductor 22 and the side end 114 is relatively large. The resonant frequency has a relatively small value due to the inductor formed of the common conductor 21, the first conductor 22, and the first frequency adjustment element 31, and the capacitor formed of the first conductor 22 and the side end 114 when the current having the first frequency flows through the common conductor 21. As a result, the antenna device 1 transmits and receives a low-frequency signal.

(3-2) A Case where Signal Having Second Frequency is Input

When a signal (current) having the second frequency is input to the common conductor 21 of the conductor pattern 20, the current having the second frequency passes through the second frequency adjustment element 32, but it is difficult for the current to pass through the first frequency adjustment element 31, so that the current having the second frequency flows through the second conductor 23.

Figure 2B:
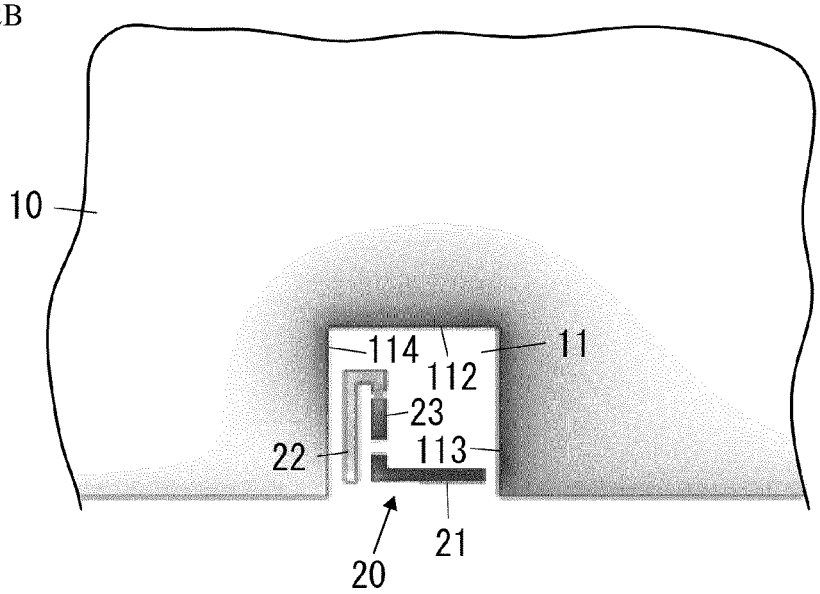
FIG. 2B is a diagram illustrating a current distribution when a current having a second frequency flows through the antenna device described above.

Since a capacitor is formed of the second conductor 23 and the side end 114, the current having the second frequency flows through the capacitor formed of the second conductor 23 and the side end 114 to the side end 114. The current having the second frequency further flows in the order of the closed end 112 and the side end 113. FIG. 2B illustrates a current distribution when a current having the second frequency (5.5 GHz) is input to the common conductor 21. Regions illustrated in black in FIG. 2B represent parts through which the more current flows. With reference to FIG. 2B, as described above, it can be seen that the more current having the second frequency flows through the common conductor 21, the second conductor 23, the side end 114, the closed end 112, and the side end 113.

When the current having the second frequency flows, the common conductor 21 and the second conductor 23, and the first frequency adjustment element 31 form an inductor. Further, as described above, the second conductor 23 and the side end 114 form the capacitor. Accordingly, LC resonance occurs, and the conductor pattern 20 inside the conductor plate 10 and the notch 11 serves as an antenna region based on this resonance, so that the antenna device 1 operates as an antenna.

In a case where the current having the second frequency flows through the common conductor 21, the inductor formed of the common conductor 21, the second conductor 23, and the second frequency adjustment element 32 is smaller than the inductor formed of the common conductor 21, the first conductor 22, and the first frequency adjustment element 31. Further, since the distance d2 between the second conductor 23 and the side end 114 is longer than the distance d1 between the first partial conductor 221 of the first conductor 22 and the side end 114, capacitance of the capacitor formed of the second conductor 23 and the side end 114 is relatively small. At this time, the first conductor 22 is seen as a floating electrode, and the second conductor 23 is electrically connected to the side end 114 with the first conductor 22 interposed therebetween. The resonant frequency has a relatively large value due to the inductance of the inductor formed of the common conductor 21, the second conductor 23, and the second frequency adjustment element 32, and the capacitance of the capacitor formed of the second conductor 23 and the side end 114 when the current having the second frequency flows through the common conductor 21. As a result, the antenna device 1 transmits and receives a high-frequency signal.

(4) Advantages

As described above, the antenna device 1 according to the present embodiment includes the conductor pattern 20 including the common conductor 21, the first conductor 22, and the second conductor 23, the power supply unit 30, the first frequency adjustment element 31, and the second frequency adjustment element 32 in the notch 11 provided in the conductor plate 10.

In the antenna device 1 according to the present embodiment, when a current having the first frequency flows through the common conductor 21, the current flows through the common conductor 21, the first conductor 22, and the side end 114, the closed end 112, and the side end 113 of the notch portion 11 in this order. At this time, the common conductor 21 and the first conductor 22, and the first frequency adjustment element 31 form an inductor, and in addition, the first partial conductor 221 of the first conductor 22 and the side end 114 configure a capacitor. As a result, LC resonance at a relatively low frequency occurs. On the other hand, when a current having the second frequency flows through the common conductor 21, the current flows through the common conductor 21, the second conductor 23, and the side end 114, the closed end 112, and the side end 113 of the notch 11 in this order. At this time, the common conductor 21, the second conductor 23, and the second frequency adjustment element 32 form an inductor, and further, the second conductor 23 and the side end 114 configure a capacitor. As a result, LC resonance at a relatively high frequency occurs.

Therefore, in the antenna device 1 according to the present embodiment, multi-resonance can be achieved in which LC resonance occurs at each of the plurality of frequencies (the first frequency and the second frequency).

Figure 3:
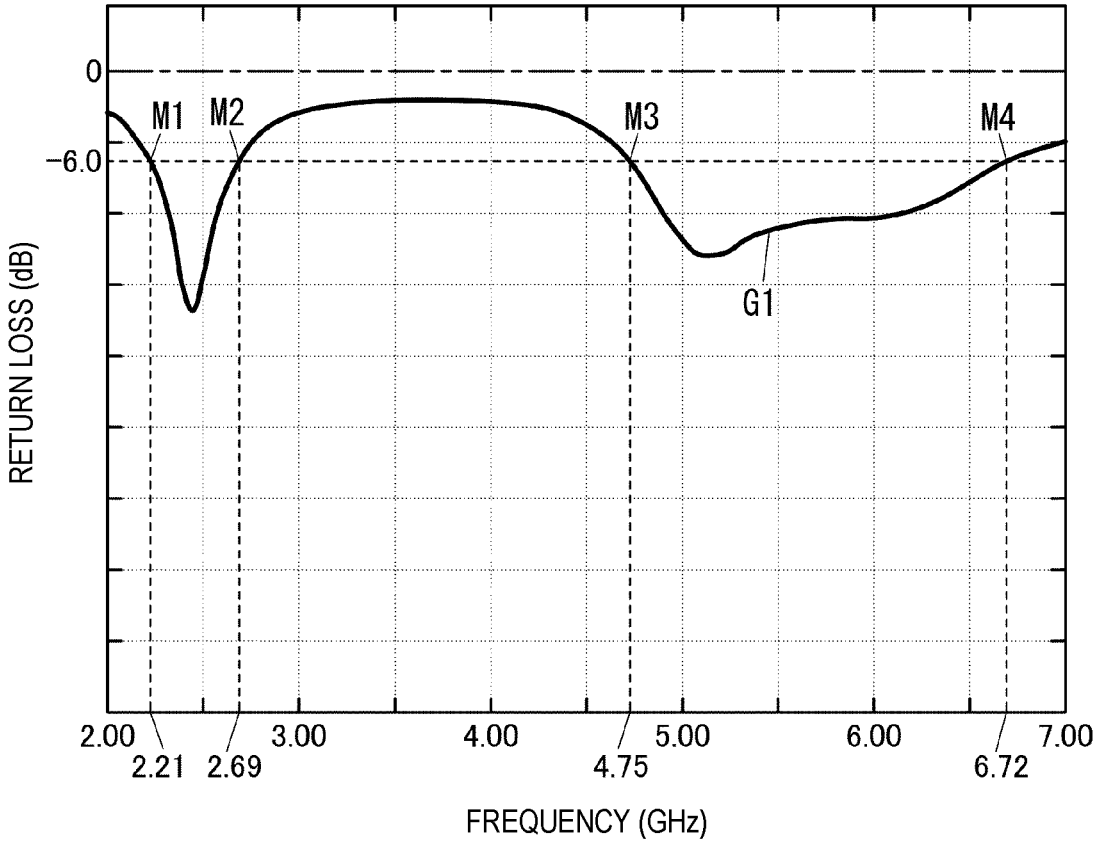
FIG. 3 is a diagram illustrating a measurement result of a return loss in the antenna device described above.

Here, a graph G1 illustrated in FIG. 3 represents a measurement result of a return loss when a frequency of a signal (current) that is input to the conductor pattern 20 is changed from 2 GHz to 7 GHz. The horizontal axis in the graph G1 in FIG. 3 represents a frequency (GHz), and the vertical axis represents a return loss (dB). At coordinates M1 in the graph G1, a value of the frequency is "2.21 GHz" and a value of the return loss corresponding thereto is "−6.0 dB". At coordinates M2 in the graph G1, a value of the frequency is "2.69 GHz", and a value of the return loss corresponding thereto is "−6.0 dB". At coordinates M3 in the graph G1, a value of the frequency is "4.75 GHz" and a value of the return loss corresponding to thereto is "−6.0 dB". At coordinates M4 in the graph G1, a value of the frequency is "6.72 GHz", and a value of the return loss corresponding thereto is "−6.0 dB".

According to this measurement result, it can be seen that stable communication can be performed at frequencies "2.21 GHz" to "2.69 GHz", and frequencies "4.75 GHz" to "6.72 GHz". That is, in the antenna device 1 according to the present embodiment, it is possible to perform stable communication by a current having the first frequency (2.4 GHz) and a current at the second frequency (5.5 GHz).

Figure 4:
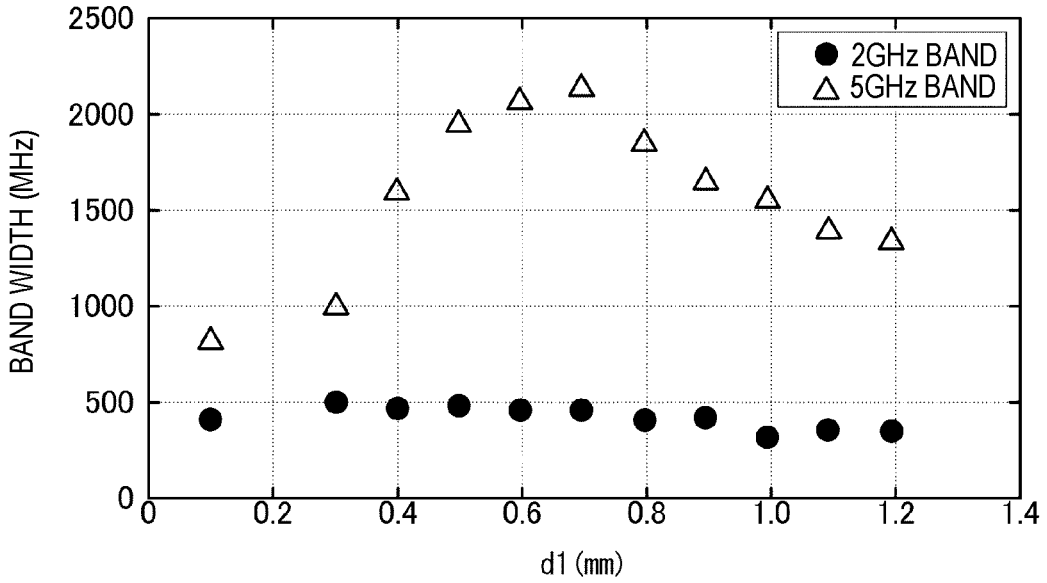
FIG. 4 is a diagram illustrating a relationship between a distance between a first partial conductor and a side end and a band width in the antenna device described above.

Further, a band width in which a value of the return loss is equal to or smaller than "−6.0 dB" varies depending on a value of the distance d1 between the first partial conductor 221 and the side end 114. Hereinafter, description will be given of the distance d1 between the first partial conductor 221 and the side end 114. FIG. 4 illustrates a relationship between the distance d1 and a band width in which a value of the return loss in each of the 2 GHz band and the 5 GHz band is "−6.0 dB". For example, when a reference of the band width in the 5 GHz band is set to 1500 MHz, the distance d1 can be equal to or longer than 0.4 mm and equal to or shorter than 1.0 mm. Accordingly, by setting the distance d1 between the first partial conductor 221 and the side end 114 within the range equal to or longer than 0.4 mm and equal to or shorter than 1.0 mm, it is possible to increase the capacitance of the capacitor formed between the first partial conductor 221 and the side end 114 and the capacitance of the capacitor formed between the second conductor 23 and the side end 114, thereby improving the efficiency of communication.

(5) Modification

Figure 5:
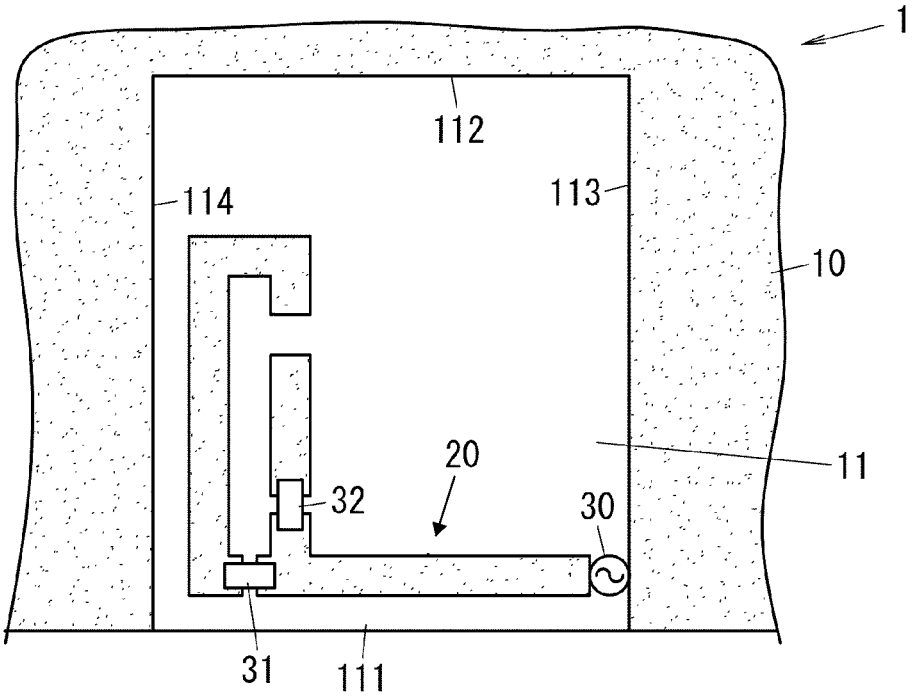
FIG. 5 is a diagram schematically illustrating a main part of an antenna device according to a modification of Embodiment 1.

In Embodiment 1, the shape of the notch 11 is a square shape, but the shape is not limited to the square shape. As illustrated in FIG. 5, for example, the shape of the notch 11 may be a rectangular shape in which the lengths of the side ends 113 and 114 are longer than the lengths of the opening end 111 and the closed end 112. The antenna device 1 in which the shape of the notch 11 is the rectangular shape as illustrated in FIG. 5 has an effect similar to that of the antenna device 1 according to Embodiment 1 in which the shape of the notch 11 is the square shape.

Embodiment 2

Figure 6A:
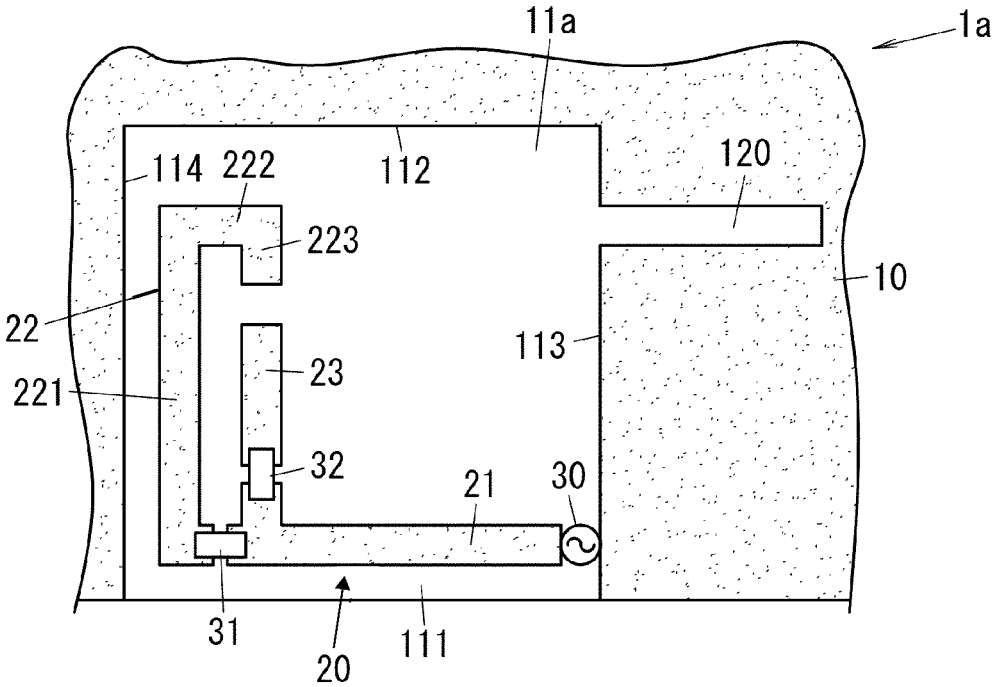
FIG. 6A is a diagram schematically illustrating a main part of an antenna device according to Embodiment 2.

In the present embodiment, the shape of the notch is different from that of the notch 11 according to Embodiment 1. Hereinafter, description will be made with reference to FIG. 6A, focusing on differences from Embodiment 1. Note that the same constituent elements as those in Embodiment 1 are denoted by the same reference signs, and description thereof will be omitted as appropriate.

A notch 11*a* according to the present embodiment has a slit 120 in a direction orthogonal to the side end 113 at the side end 113. The notch 11*a* is configured such that a length of the entire perimeter excluding the opening end 111 in the notch 11*a* according to the present embodiment is half of the wave length of the first frequency.

When a current having the first frequency flows through the common conductor 21 of the conductor pattern 20 according to the present embodiment, the current having the first frequency flows into the side end 114 through a capacitor formed of the first partial conductor 221 and the side end 114, as in Embodiment 1. The current having the first frequency further flows in the order of the closed end 112 and the side end 113. At the side end 113, the current having the first frequency passes around the slit 120. Further, as in Embodiment 1, a resonant frequency has a relatively small value based on inductance of an inductor formed of the common conductor 21, the first conductor 22, and the first frequency adjustment element 31, and capacitance of the capacitor formed of the first conductor 22 and the side end 114 when the current having the first frequency flows through the common conductor 21. As a result, an antenna device 1*a* transmits and receives a low-frequency signal.

When a current having the second frequency flows through the common conductor 21 of the conductor pattern 20 according to the present embodiment, the current having the second frequency flows into the side end 114 through a capacitor formed of the second conductor 23 and the side end 114, as in Embodiment 1. The current having the second frequency further flows in the order of the closed end 112 and the side end 113. At the side end 113, the current having the second frequency passes around the slit 120. Further, as in Embodiment 1, a resonant frequency has a relatively large value due to inductance of an inductor formed of the common conductor 21, the second conductor 23, and the second frequency adjustment element 32, and capacitance of the capacitor formed of the second conductor 23 and the side end 114 when the current having the second frequency flows to the common conductor 21. As a result, the antenna device 1*a* transmits and receives a high-frequency signal.

Therefore, in the antenna device 1*a* according to the present embodiment, multi-resonance can be achieved.

Further, other components may be provided on a printed board on which the conductor plate 10 is provided. Therefore, depending on the arrangement of the components, it may be difficult to form the notch having a rectangular shape such that the length of the entire perimeter excluding the opening end 111 of the notch 11*a* is the half of the wave length of the first frequency when the notch having the rectangular shape is formed. Therefore, as in the antenna device 1*a* according to the present embodiment, by providing the slit 120 in the notch 11*a*, the length of the entire perimeter excluding the opening end 111 of the notch 11*a* can be configured to be the half of the wave length of the first frequency.

Modification 1 of the present embodiment will now be described.

Figure 6B:
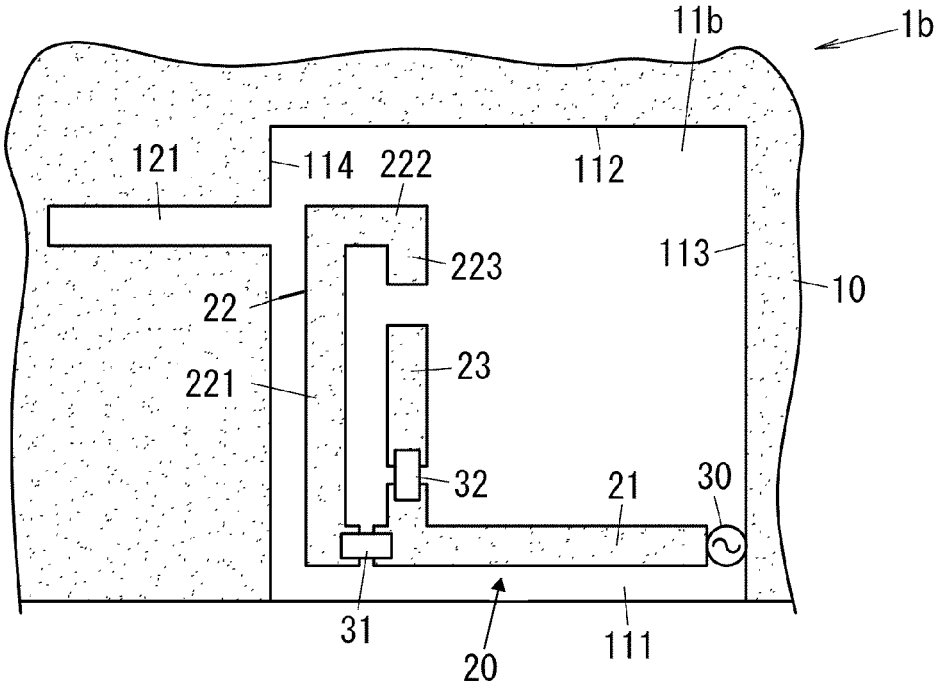
FIG. 6B is a diagram schematically illustrating a main part of an antenna device according to Modification 1 of Embodiment 2.

In Embodiment 2, the configuration is adopted in which the slit 120 is provided at the side end 113, but the present disclosure is not limited to this configuration. As illustrated in FIG. 6B, a notch 11*b* of an antenna device lb according to Modification 1 has a slit 121 in a direction orthogonal to the side end 114 at the side end 114. The notch 11*b* is configured such that a length of the entire perimeter excluding the opening end 111 in the notch 11*b* is half of the wave length of the first frequency.

The antenna device 1*b* according to Modification 1 has an equivalent effect to that of the antenna device 1*a* according to Embodiment 2 because a position of the slit 121 is only different from the position of the slit 120 according to Embodiment 2.

Next, Modification 2 of the present embodiment will be described.

Figure 7:
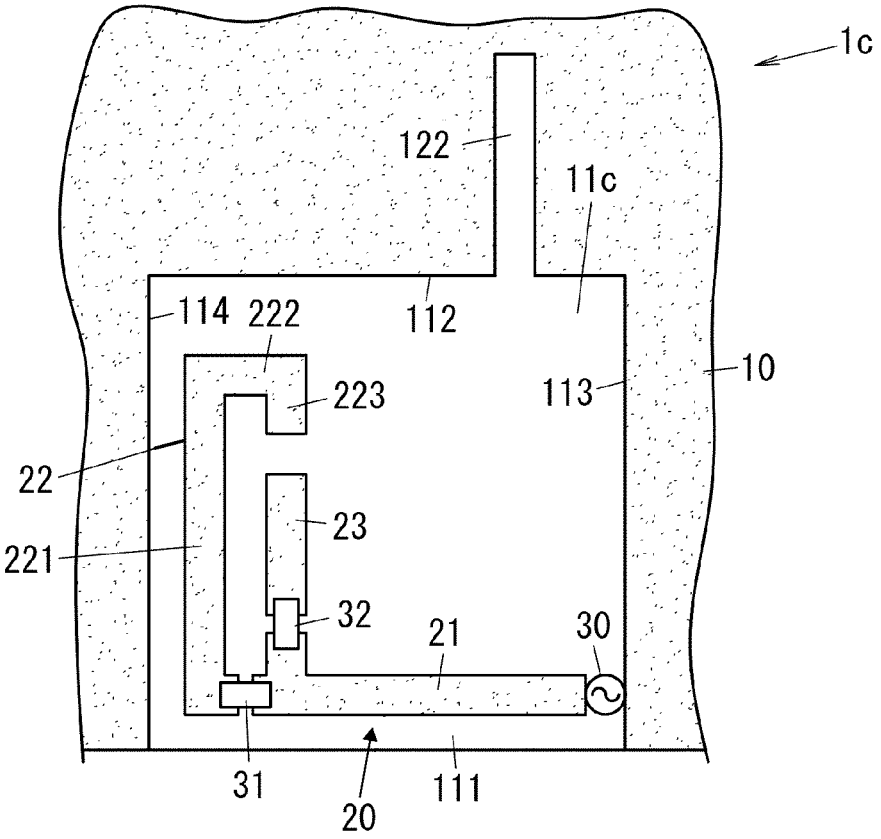
FIG. 7 is a diagram schematically illustrating a main part of an antenna device according to Modification 2 of Embodiment 2.

As illustrated in FIG. 7, a notch 11*c* of an antenna device 1*c* according to Modification 2 has a slit 122 in a direction orthogonal to the closed end 112 at the closed end 112. The notch 11*c* is configured such that a length of the entire perimeter excluding the opening end 111 in the notch 11*c* is half of the wave length of the first frequency.

The antenna device 1*c* according to Modification 2 has an equivalent effect to that of the antenna device 1*a* according to Embodiment 2 because a position of the slit 122 is only different from the position of the slit 120 according to Embodiment 2.

Next, Modification 3 of the present embodiment will be described.

Figure 8:
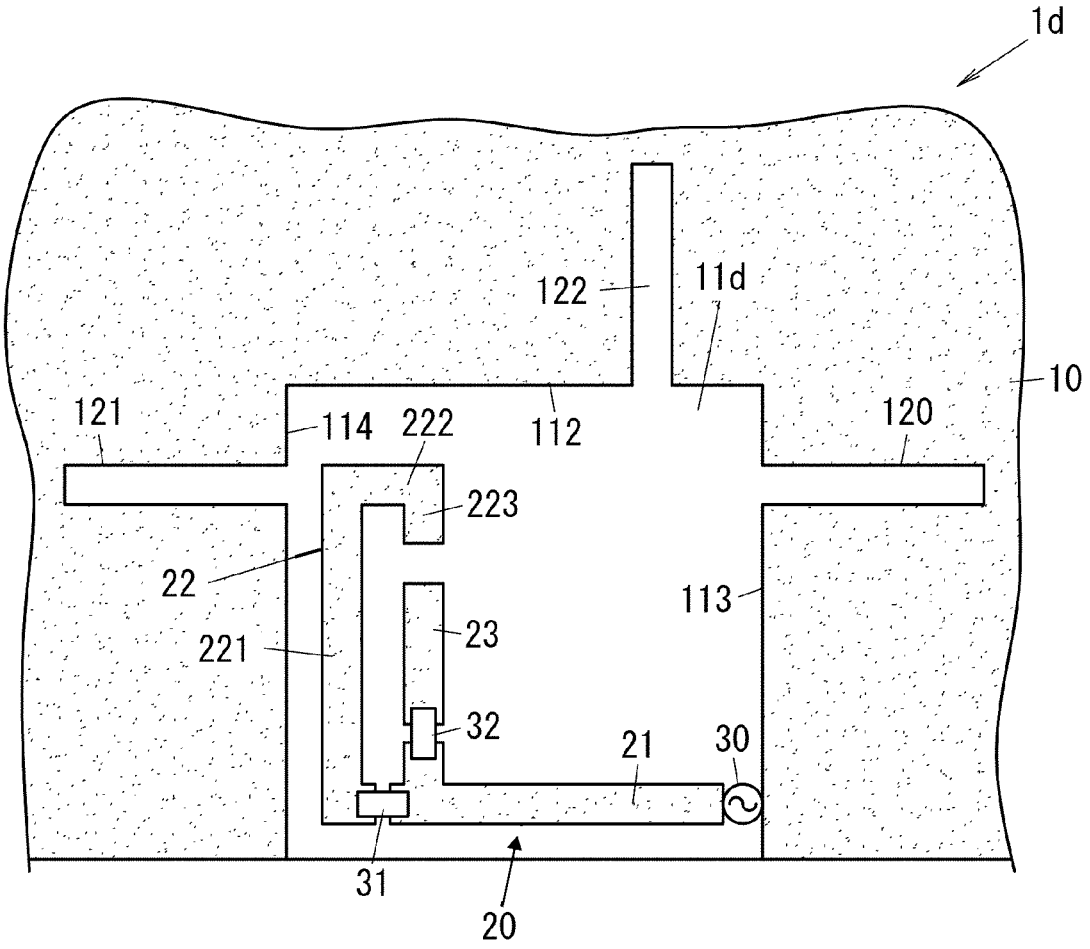
FIG. 8 is a diagram schematically illustrating a main part of an antenna device according to Modification 3 of Embodiment 2.

As illustrated in FIG. 8, a notch 11*d* of an antenna device 1*d* according to Modification 3 has the slit 120 described in Embodiment 2, the slit 121 described in Modification 1, and the slit 122 described in Modification 2. The notch 11*d* is configured such that a length of the entire perimeter excluding the opening end 111 in the notch 11*d* is half of the wave length of the first frequency.

Figure 9A:
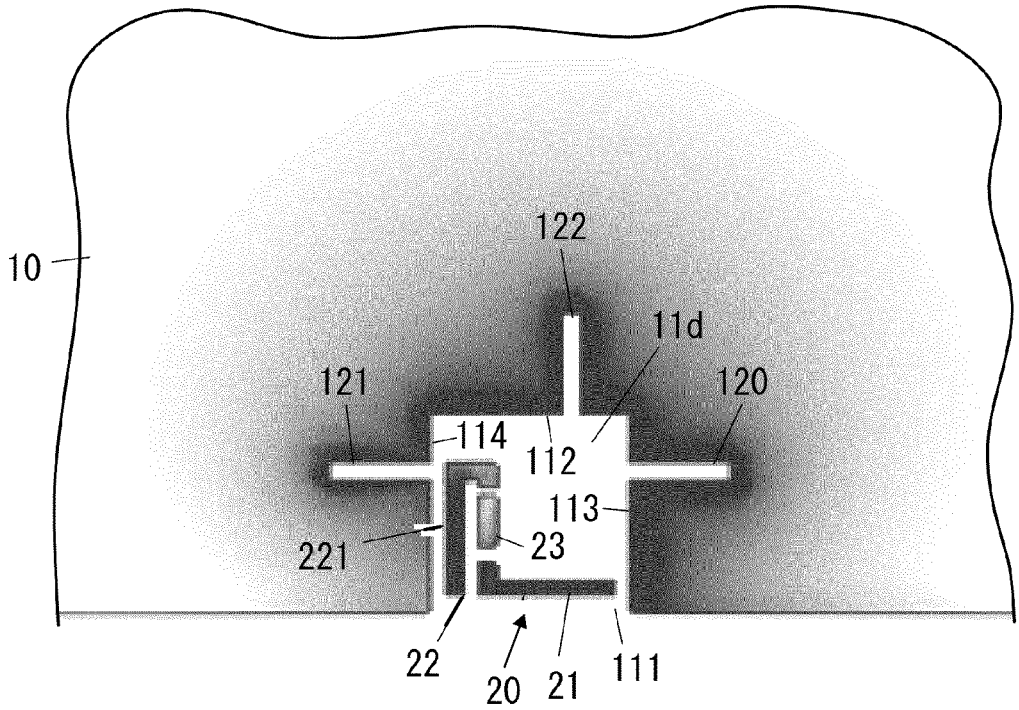
FIG. 9A is a diagram illustrating a current distribution when a current having a first frequency flows through the antenna device described above.

When a signal (current) having the first frequency is input to the common conductor 21 of the conductor pattern 20 according to Modification 3, the current having the first frequency passes through the first frequency adjustment element 31, but the current is less likely to pass through the second frequency adjustment element 32. Further, capacitance is formed between the first partial conductor 221 of the first conductor 22 and the side end 114. Therefore, the current having the first frequency flows through the common conductor 21, the first frequency adjustment element 31, the first conductor 22 (in particular, the first partial conductor 221), the side end 114, the closed end 112, and the side end 113 in this order. FIG. 9A illustrates a current distribution when a current having the first frequency (2.4 GHz) is input to the common conductor 21. Regions illustrated in black in FIG. 9A represent parts through which the more current flows. With reference to FIG. 9A, as described above, it can be seen that the more current having the first frequency flows through the common conductor 21, the first conductor 22, the side end 114, the closed end 112, and the side end 113.

Therefore, in the antenna device 1*d* according to Modification 3, when the current having the first frequency flows, LC resonance occurs due to inductance formed of the common conductor 21 and the first conductor 22, and the first frequency adjustment element 31, and the capacitance formed of the first partial conductor 221 and the side end 114, similarly to the antenna device 1 according to Embodiment 1. The conductor pattern 20 inside the conductor plate 10 and the notch 11*d* serves as an antenna region based on the resonance, and thus the antenna device 1*d* operates as an antenna. At this time, a resonant frequency is a relatively small value, similarly to Embodiment 1. As a result, the antenna device 1*d* transmits and receives a low-frequency signal.

Figure 9B:
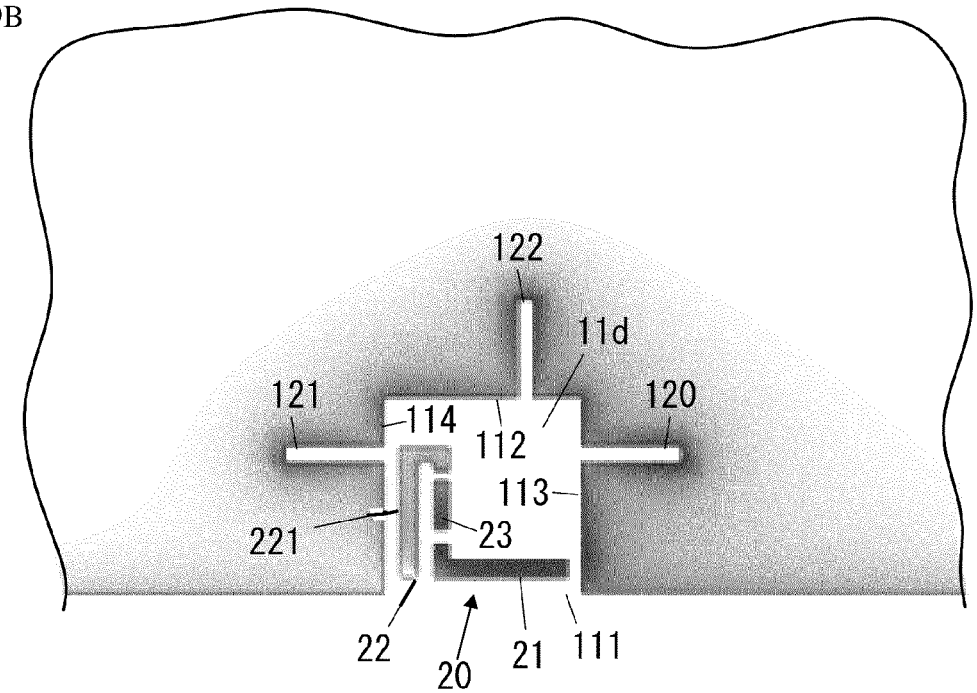
FIG. 9B is a diagram illustrating a current distribution when a current having a second frequency flows through the antenna device described above.

When a signal (current) having the second frequency is input to the common conductor 21 of the conductor pattern 20 according to Modification 3, the current having the second frequency passes through the second frequency adjustment element 32, but the signal is less likely to pass through the first frequency adjustment element 31. Further, capacitance is formed between the second conductor 23 and the side end 114. Therefore, the current having the second frequency flows through the common conductor 21, the second frequency adjustment element 32, the second conductor 23, the side end 114, the closed end 112, and the side end 113 in this order. FIG. 9B illustrates a current distribution when a current having the second frequency (5.5 GHz) is input to the common conductor 21. Regions illustrated in black in FIG. 9B represent parts through which the more current flows. With reference to FIG. 9B, as described above, it can be seen that the more current having the first frequency flows through the common conductor 21, the second conductor 23, the side end 114, the closed end 112, and the side end 113.

Therefore, in the antenna device 1*d* according to Modification 3, when the current having the second frequency flows, LC resonance occurs due to inductance formed of the common conductor 21 and the second conductor 23, and the second frequency adjustment element 32, and the capacitance formed of the second conductor 23 and the side end 114, similarly to the antenna device 1 according to Embodiment 1. The conductor pattern 20 inside the conductor plate 10 and the notch 11*d* serves as an antenna region based on the resonance, and thus the antenna device 1*d* operates as an antenna. At this time, a resonant frequency is a relatively large value, similarly to Embodiment 1. As a result, the antenna device 1*d* transmits and receives a high-frequency signal.

As described above, in the antenna device 1*d* according to Modification 3, multi-resonance can be achieved, similarly to Embodiment 1.

Figure 10:
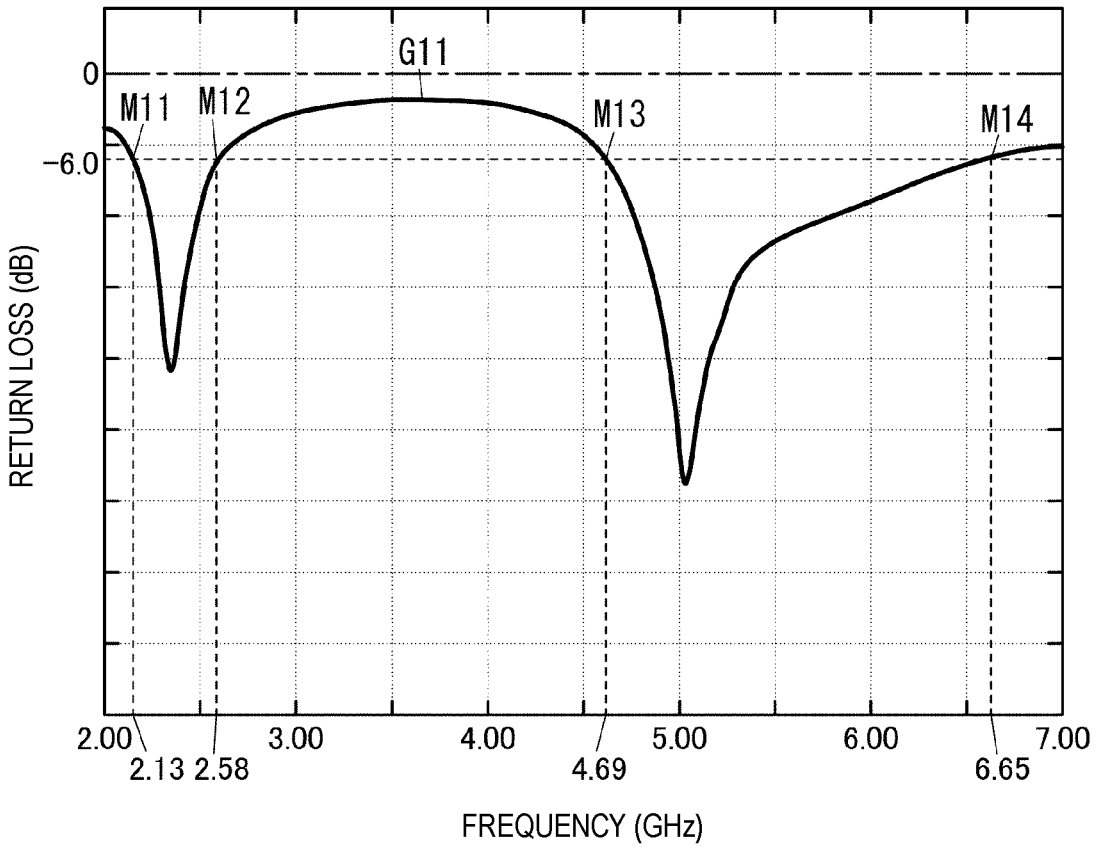
FIG. 10 is a diagram illustrating a measurement result of a return loss in the antenna device described above.

Here, FIG. 10 illustrates a measurement result of a return loss in the antenna device 1*d* according to Modification 3. A graph G11 illustrated in FIG. 10 indicates a measurement result of a return loss when a frequency of a signal (current) that is input to the conductor pattern 20 is changed from 2 GHz to 7 GHz. The horizontal axis in the graph G11 in FIG. 10 represents a frequency (GHz), and the vertical axis represents a return loss (dB). At coordinates M11 in the graph G11, a value of the frequency is "2.13 GHz", and a value of the return loss corresponding thereto is "−6.0 dB". At coordinates M12 in the graph G11, a value of the frequency is "2.58 GHz", and a value of the return loss corresponding thereto is "−6.0 dB". At coordinates M13 in the graph G11, a value of the frequency is "4.69 GHz" and a value of the return loss corresponding thereto is "−6.0 dB". At coordinates M14 in the graph G11, a value of the frequency is "6.65 GHz" and a value of the return loss corresponding thereto is "−6.0 dB".

According to this measurement result, it can be seen that stable communication can be performed at frequencies "2.13 GHz" to "2.58 GHz", and frequencies "4.69 GHz" to "6.65 GHz". That is, the antenna device 1*d* according to Modification 3 can perform stable communication by a current having the first frequency (2.4 GHz) and a current having the second frequency (5.5 GHz).

Next, Modification 4 to Modification 6 of the present embodiment will be described.

Figure 11A:
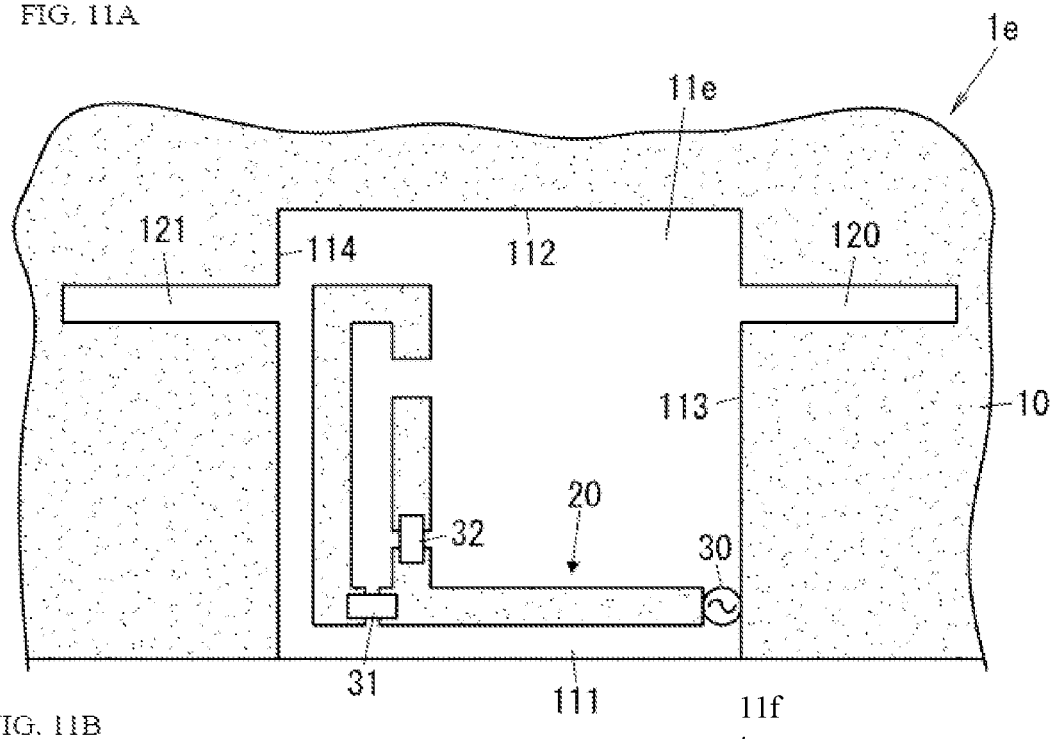
FIG. 11A is a diagram schematically illustrating a main part of an antenna device according to Modification 4 of Embodiment 2.

As illustrated in FIG. 11A, a notch 11*e* of an antenna device 1*e* according to Modification 4 has the slit 120 described in Embodiment 2 and the slit 121 described in Modification 1. The notch 11*e* is configured such that a length of the entire perimeter excluding the opening end 111 in the notch 11*e* is half of the wave length of the first frequency.

Figure 11B:
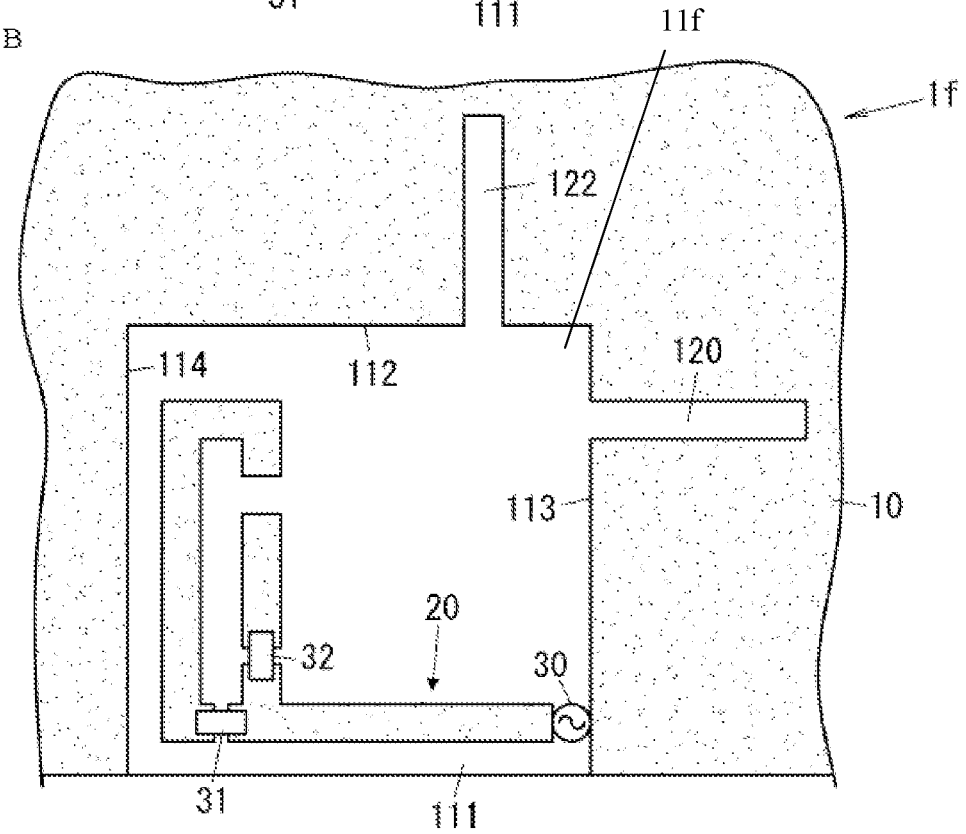
FIG. 11B is a diagram schematically illustrating a main part of an antenna device according to Modification 5 of Embodiment 2.

As illustrated in FIG. 11B, a notch 11*f* of an antenna device 1*f* according to Modification 5 has the slit 120 described in Embodiment 2 and the slit 122 described in Modification 2. The notch 11*f* is configured such that a length of the entire perimeter excluding the opening end 111 in the notch 11*f* is half of the wave length of the first frequency.

Figure 12:
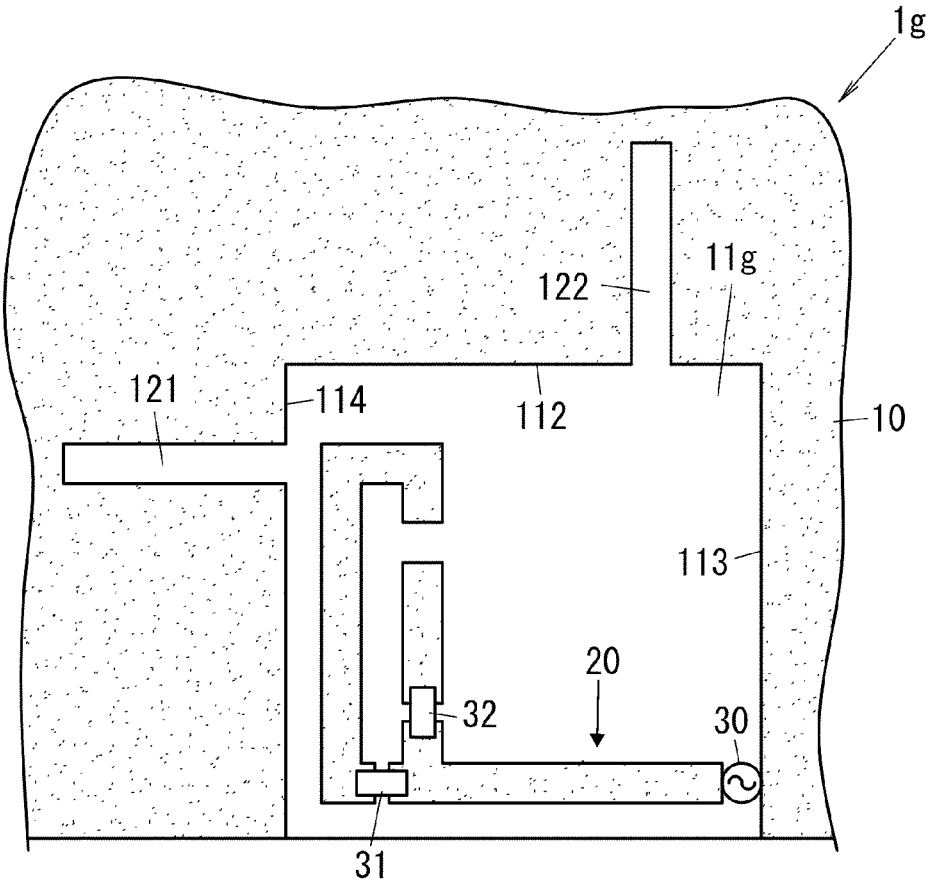
FIG. 12 is a diagram schematically illustrating a main part of an antenna device according to Modification 6 of Embodiment 2.

As illustrated in FIG. 12, a notch 11*g* of the antenna device 1*g* according to Modification 6 has the slit 121 described in Modification 1 and the slit 122 described in Modification 2. The notch 11*g* is configured such that a length of the entire perimeter excluding the opening end 111 in the notch 11*g* is half of the wave length of the first frequency.

The antenna devices 1*e* to 1*g* according to these modifications have similar effects to those of the antenna devices 1*a* to 1*d* according to Embodiment 1 and Modifications 1 to 3.

Next, Modification 7 of the present embodiment will be described.

Figure 13:
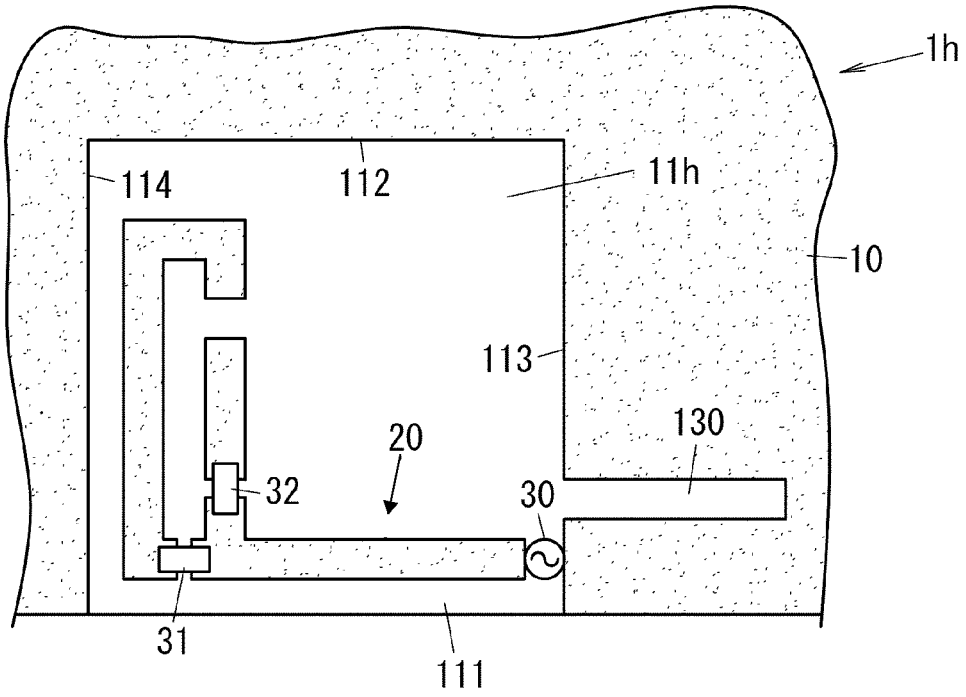
FIG. 13 is a diagram schematically illustrating a main part of an antenna device according to Modification 7 of Embodiment 2.

In an antenna device 1*h* according to Modification 7, a position of a notch provided at the side end 113 is different from the position of the slit 120 described in Embodiment 2. In the antenna device 1*h* according to Modification 7, a slit 130 (slit 130 provided at the side end 113) included in a notch 11*h* is provided on the opening end 111 side with respect to a midpoint of the side end 113, as illustrated in FIG. 13. In other words, the slit 130 is provided at the side end 113 such that a distance from the slit 130 to the opening end 111 is shorter than a distance from the slit 130 to the closed end 112.

The antenna device 1*h* according to Modification 7 has a similar effect that of the antenna device 1*a* according to Embodiment 2 because the position of the slit 130 is only different from the position of the slit 120 according to Embodiment 2. That is, the notch provided at the side end 113 may be provided on the opening end 111 side with respect to the midpoint of the side end 113, or may be provided on the closed end 112 side. Of course, the notch provided at the side end 113 may be provided at the midpoint of the side end 113.

Note that the position where the slit 121 described in Modification 1 is provided at the side end 114 is not limited. The slit 121 provided at the side end 113 may be provided on the opening end 111 side with respect to a midpoint of the side end 114, or may be provided on the closed end 112 side. Alternatively, the slit 121 provided at the side end 113 may be provided at the midpoint of the side end 114.

Similarly, the slit 122 described in Modification 2 may be provided on the side end 113 side with respect to a midpoint of the closed end 112, or may be provided on the side end 114 side. Alternatively, the slit 122 provided at the closed end 112 may be provided at the midpoint of the closed end 112.

(Other Modifications)

Hereinafter, other modifications will be listed. Note that modifications to be described below can be applied in combination with each of the above-described embodiments as appropriate.

In each of the above-described embodiments, the shape of the notch 11 is not limited to the rectangular shape, and may be a trapezoidal shape, a curved shape (for example, a semicircular shape).

In each of the above-described embodiments, the configuration is adopted in which the second frequency adjustment element 32 is a ceramic chip inductor, but the present disclosure is not limited to this configuration. The second frequency adjustment element 32 may be a ceramic chip capacitor.

In addition, when the first frequency adjustment element 31 and the second frequency adjustment element 32 are formed of chip inductors, each of the first frequency adjustment element 31 and the second frequency adjustment element 32 may be a chip inductor of a winding type instead of ceramics.

Alternatively, a configuration may be employed in which a tip end portion (first portion 100) facing the first conductor 22 in the common conductor 21 and a tip end portion facing the common conductor 21 (first portion 100) in the first conductor 22 are reduced in width to form an inductor. Similarly, a configuration may be adopted in which a tip end portion (second portion 101) facing the second conductor 23 in the common conductor 21 and a tip end portion facing the common conductor 21 (second portion 101) in the second conductor 23 are reduced in width to form an inductor or a capacitor.

In addition, in the above-described embodiments, the antenna devices 1 and 1*a* to 1*h* are configured to include the first frequency adjustment element 31 and the second frequency adjustment element 32, but the present disclosure is not limited to this configuration. The first frequency adjustment element 31 and the second frequency adjustment element 32 are optional to the constituent elements of the antenna devices 1 and 1*a* to 1*h*. For example, even in configurations in which the antenna devices 1 and 1*a* to 1*h* do not include the first frequency adjustment element 31, that is, even in a case where the first conductor 22 is directly connected to the common conductor 21, radiation at the first frequency (2.4 GHz) can be performed by appropriately adjusting the length of the first conductor 22. Similarly, even in configurations in which the antenna devices 1 and 1*a* to 1*h* do not include the second frequency adjustment element 32, that is, even in a case where the second conductor 23 is directly connected to the common conductor 21, radiation at the second frequency (5.5 GHz) can be performed by appropriately adjusting the length of the second conductor 23.

(Summary)

It will be apparent from the above-described embodiments and the like that the following aspects have been invented.

An antenna device (1; 1*a* to 1*h*) of a first aspect transmits a signal having a first frequency and a signal having a second frequency higher than the first frequency. The antenna device (1; 1*a* to 1*h*) includes a conductor plate (10) provided with a notch (11; 11*a* to 11*h*) having an opening end (111) at one end, a closed end (112) at the other end, and a pair of side ends (113; 114) between the opening end (111) and the closed end (112), a conductor pattern (20), and a power supply unit (30). The conductor pattern (20) is provided in the notch (11; 11*a* to 11*h*), and includes a common conductor (21), a first conductor (22), and a second conductor (23). The power supply unit (30) is disposed at a connection portion between the conductor plate (10) and the conductor pattern (20), and is configured to supply power to the conductor pattern (20). Each of the first conductor (22) and the second conductor (23) is connected to the power supply unit (30) with the common conductor (21) interposed therebetween. The power supply unit (30) is disposed at a position where a distance to the opening end (111) is shorter than a distance to the closed end (112) at one side end (113) of the pair of side ends (113; 114). A part (first partial conductor 221) of the first conductor (22) is positioned between the second conductor (23) and the other side end (114) of the pair of side ends (113; 114). A length of the first conductor (22) in a direction along the other side end (114) is longer than a length of the second conductor (23) in the direction along the other side end (114).

According to this configuration, it is possible to resonate at the first frequency and the second frequency. Therefore, resonance corresponding to each of a plurality of frequencies can be performed, and a plurality of signals having different frequencies from each other can be transmitted and received. Further, an area is large in which the conductor plate (10) and the conductor pattern (20) operate as an antenna, thereby improving the efficiency as the antenna.

In the antenna device (1; 1*a* to 1*h*) of a second aspect, in the first aspect, an open end (224) of the first conductor (22) and an open end (231) of the second conductor (23) face each other to form a capacitor.

According to this configuration, the capacitor is formed of the open end (224) of the first conductor (22) and the open end (231) of the second conductor (23) to have capacitance between the open end (224) and the open end (231). Thereby, it is possible to easily set a constant of each of a first frequency adjustment element (31) and a second frequency adjustment element (32).

In the antenna device (1; 1*a* to 1*h*) of a third aspect, in the first or second aspect, the notch (11; 11*a* to 11*h*) has a rectangular shape.

According to this configuration, capacitance between the other side end (114) and the first conductor (22) and capacitance between the other side end (114) and the second conductor (23) can be easily adjusted.

In the antenna device (1) of a fourth aspect, in any one of the first to third aspects, a total length of the pair of side ends (113; 114) and the closed end (112) is half of a wave length of the first frequency.

According to this configuration, it is possible to easily obtain a desired current distribution for a current distribution at the first frequency and a current distribution at the second frequency in the conductor plate (10) and the conductor pattern (20).

In the antenna device (1*a* to 1*h*) of a fifth aspect, in any one of the first to third aspects, the notch (11*a* to 11*h*) has at least one slit (120 to 122; 130). A length of an entire perimeter excluding the opening end (111) in the notch (11*a* to 11*h*) is half of a wave length of the first frequency.

According to this configuration, it is possible to easily obtain a desired current distribution for a current distribution at the first frequency and a current distribution at the second frequency in the conductor plate (10) and the conductor pattern (20).

In the antenna device (1; 1*a* to 1*h*) of a sixth aspect, in any one of the first to fifth aspects, a distance between the first conductor (22) and the closed end (112) is longer than a distance between the first conductor (22) and the other side end (114).

According to this configuration, it is possible to easily obtain capacitance between the first conductor (22) and the other side end (114) compared to capacitance between the first conductor (22) and the closed end (112). This makes it possible to concentrate a current between the first conductor (22) and the other side end (114). As a result, a desired current distribution can be easily obtained.

In the antenna device (1; 1*a* to 1*h*) of a seventh aspect, in any one of the first to sixth aspects, a distance between the second conductor (23) and the closed end (112) is longer than a distance between the second conductor (23) and the other side end (114) at the first frequency.

According to this configuration, it is possible to easily obtain capacitance between the second conductor (23) and the other side end (114) compared to capacitance between the second conductor (23) and the closed end (112). This makes it possible to concentrate a current between the second conductor (23) and the other side end (114). As a result, a desired current distribution can be easily obtained at the second frequency.

In the antenna device (1; 1*a* to 1*h*) of an eighth aspect, in any one of the first to seventh aspects, the power supply unit (30) is disposed on a side of the opening end (111) of the one side end (113).

According to this configuration, in a path of a current from the power supply unit (30) to the common conductor (21), there is no path in a direction opposite to a direction of a current flowing through the first conductor (22) and the second conductor (23). In other words, since a current having a phase opposite to a phase of a current flowing through the first conductor (22) and the second conductor (23) does not flow, it is possible to perform stable communication.

In the antenna device (1; 1*a* to 1*h*) of a ninth aspect, in any one of the first to eighth aspects, capacitance of a capacitor formed between the first conductor (22) and the other side end (114) is larger than capacitance of a capacitor formed between the second conductor (23) and the other side end (114).

According to this configuration, it is possible to generate resonance at a low frequency by using the first conductor (22), and to generate resonance at a high frequency by using the second conductor (23).

In the antenna device (1; 1*a* to 1*h*) of a tenth aspect, in any one of the first to ninth aspects, a first frequency adjustment element (31) and a second frequency adjustment element (32) are further provided. The first frequency adjustment element (31) connects the common conductor (21) and the first conductor (22) to each other. The second frequency adjustment element (32) connects the common conductor (21) and the second conductor (23) to each other.

According to this configuration, the first frequency adjustment element (31) can adjust the first frequency, and the second frequency adjustment element (32) can adjust the second frequency.

In the antenna device (1; 1*a* to 1*h*) of an eleventh aspect, in the tenth aspect, each of the first frequency adjustment element (31) and the second frequency adjustment element (32) is configured such that reactance of the first frequency adjustment element (31) is smaller than reactance of the second frequency adjustment element (32) at the first frequency, and reactance of the second frequency adjustment element (32) is smaller than reactance of the first frequency adjustment element (31) at the second frequency.

According to this configuration, it is possible to configure such that a low-frequency current flows into the first conductor (22), and a high-frequency current flows into the second conductor (23).

In the antenna device (1; 1*a* to 1*h*) of a twelfth aspect, in the tenth or eleventh aspect, the first frequency adjustment element (31) is configured such that impedance when the first conductor (22) is viewed from the power supply unit (30) is lower than impedance when the second conductor (23) is viewed from the power supply unit (30), at the first frequency.

According to this configuration, it is possible to cause the first frequency adjustment element (31) to function as a filter for passing a signal having a predetermined frequency.

In the antenna device (1; 1*a* to 1*h*) of a thirteenth aspect, in any one of the tenth to twelfth aspects, the second frequency adjustment element (32) is configured such that impedance when the second conductor (23) is viewed from the power supply unit (30) is lower than impedance when the first conductor (22) is viewed from the power supply unit (30), at the second frequency.

According to this configuration, it is possible to cause the second frequency adjustment element (32) to function as a filter for passing a signal having a predetermined frequency.

REFERENCE SIGNS LIST

1, 1*a* to 1*h* ANTENNA DEVICE
10 CONDUCTOR PLATE
11, 11*a* to 11*h* NOTCH
20 CONDUCTOR PATTERN
21 COMMON CONDUCTOR
22 FIRST CONDUCTOR
23 SECOND CONDUCTOR
30 POWER SUPPLY UNIT
31 FIRST FREQUENCY ADJUSTMENT ELEMENT
32 SECOND FREQUENCY ADJUSTMENT ELEMENT
111 OPENING END
112 CLOSED END
113, 114 SIDE END
120 to 122, 130 SLIT
224, 231 OPEN END

The invention claimed is:

1. An antenna device configured to transmit a first signal having a first frequency and a second signal having a second frequency, the second frequency being greater than the first frequency, the antenna device comprising: a conductor plate comprising a notch having an open end, a closed end, and a pair of side ends between the open end and the closed end; a conductor pattern in the notch, the conductor pattern comprising a common conductor, a first conductor, and a second conductor; and a power supply between the conductor plate and the conductor pattern, the power supply being configured to supply power to the conductor pattern, wherein: the first conductor and the second conductor are each connected to the power supply with the common conductor interposed between the first conductor, the second conductor, and the power supply, the power supply is located at a first side end of the pair of the side ends such that a distance from the power supply to the open end is less than a distance from the power supply to the closed end, the first conductor is disposed nearer to a second side end of the pair of the side ends than the common conductor is disposed to the second side end, a part of the first conductor is between the second conductor and the second side end of the pair of the side ends, and a length of the first conductor in a direction along the second side end is greater than a length of the second conductor in the direction along the second side end.

2. The antenna device according to claim 1, wherein an open end of the first conductor and an open end of the second conductor face each other to form a capacitor.

3. The antenna device according to claim 1, wherein the notch has a rectangular shape.

4. The antenna device according to claim 1, wherein a total length of the pair of side ends and the closed end is half of a wavelength of the first frequency.

5. The antenna device according to claim 1, wherein:

the notch has at least one slit, and a length of a perimeter of the notch, including the at least one slit and excluding the open end, is half of a wavelength of the first frequency.

6. The antenna device according to claim 5, wherein the at least one slit extends in a direction orthogonal to one side end of the pair of the side ends or to the closed end.

7. The antenna device according to claim 1, wherein a distance between the first conductor and the closed end is greater than a distance between the first conductor and the second side end.

8. The antenna device according to claim 1, wherein a distance between the second conductor and the closed end is greater than a distance between the second conductor and the second side end.

9. The antenna device according to claim 1, wherein a capacitance of a capacitor formed between the first conductor and the second side end is greater than a capacitance of a capacitor formed between the second conductor and the second side end.

10. The antenna device according to claim 1, further comprising:

a first frequency adjustment circuit element configured to connect the common conductor to the first conductor; and a second frequency adjustment circuit element configured to connect the common conductor to the second conductor.

11. The antenna device according to claim 10, wherein the first frequency adjustment circuit element and the second frequency adjustment circuit element are each configured such that:

at the first frequency, a reactance of the first frequency adjustment circuit element is less than a reactance of the second frequency adjustment circuit element, and at the second frequency, a reactance of the second frequency adjustment circuit element is less than a reactance of the first frequency adjustment circuit element.

12. The antenna device according to claim 10, wherein, at the first frequency, the first frequency adjustment circuit element is configured such that an impedance when the first conductor is viewed from the power supply is less than an impedance when the second conductor is viewed from the power supply.

13. The antenna device according to claim 10, wherein, at the second frequency, the second frequency adjustment circuit element is configured such that an impedance when the second conductor is viewed from the power supply is less than an impedance when the first conductor is viewed from the power supply, at the second frequency.

14. The antenna device according to claim 10, wherein the first frequency adjustment circuit element and the second frequency adjustment circuit element are ceramic chip.

15. The antenna device according to claim 1, wherein the power supply is located between the first side end of the notch and the conductor pattern.

* * * * *